US011547911B2

(12) United States Patent
Krauter

(10) Patent No.: US 11,547,911 B2
(45) Date of Patent: Jan. 10, 2023

(54) GOLF ACCESSORY HOLDER

(71) Applicant: Gary Krauter, Geneva, IL (US)

(72) Inventor: Gary Krauter, Geneva, IL (US)

( * ) Notice: Subject to any disclaimer, the term of this patent is extended or adjusted under 35 U.S.C. 154(b) by 214 days.

(21) Appl. No.: 17/079,710

(22) Filed: Oct. 26, 2020

(65) Prior Publication Data

US 2021/0121750 A1 Apr. 29, 2021

Related U.S. Application Data

(60) Provisional application No. 62/925,999, filed on Oct. 25, 2019.

(51) Int. Cl.

| | |
|---|---|
| ***A63B 57/20*** | (2015.01) |
| ***A63B 57/00*** | (2015.01) |
| *A63B 57/30* | (2015.01) |
| *A63B 55/00* | (2015.01) |

(52) U.S. Cl.

CPC ..... *A63B 57/203* (2015.10); *A63B 55/408* (2015.10); *A63B 57/30* (2015.10)

(58) Field of Classification Search

CPC ..... A63B 57/203; A63B 55/408; A63B 57/20; A63B 2209/10; A63B 57/207

USPC ..... 473/405–408; 206/315.1, 315.3, 315.5; 224/251, 666, 268, 269, 933, 918

See application file for complete search history.

(56) References Cited

U.S. PATENT DOCUMENTS 4,736,877 A * 4/1988 Clark ..... A63B 57/20 224/678
6,220,973 B1 * 4/2001 Hsu ..... A63B 57/203 473/406
6,808,095 B2 * 10/2004 Hurtgam ..... A63B 55/408 473/405
D505,473 S * 5/2005 Foley ..... D21/793
6,910,718 B2 * 6/2005 Chareas ..... B42D 5/042 455/550.1
D643,494 S * 8/2011 Book ..... D21/793
D674,803 S * 1/2013 Westrup ..... A45C 3/02 D14/440
2009/0209369 A1 * 8/2009 Smith ..... A63B 57/50 224/183

(Continued)

OTHER PUBLICATIONS

GClip Fact Sheet, Fine Tune Golf Inc., Mar. 31, 2009.
https://shucaddy.com/, Sep. 9, 2020.

*Primary Examiner* — Nini F Legesse
(74) *Attorney, Agent, or Firm* — Argus Intellectual Enterprise; Jordan Sworen; Daniel Enea

(57) ABSTRACT

A holder for securing golf accessories therein and attaching to a belt, golf bag, waist band, piece of clothing or other article that is carried while golfing. The holder includes a housing having a base and a sidewall extending from the base toward an open face defining a compartment that can receive a ball divot repair tool. The sidewall forms a perimeter of the housing, wherein the open face extends the perimeter to allow the ball divot repair tool to be quickly and conveniently removed and inserted therefrom. A divot repair tool fastener is disposed on a surface of the housing to secure the ball divot repair tool thereto. In some embodiments, the divot repair tool is included and comprises a ball marker that is interchangeable with other ball markers in order to allow for a variety of colors or embodiments to be displayed on the divot repair tool.

18 Claims, 6 Drawing Sheets

(56) References Cited

U.S. PATENT DOCUMENTS

| | | | | |
|---|---|---|---|---|
| 2009/0209370 | A1* | 8/2009 | Smith | A63B 57/353<br>473/406 |
| 2012/0043234 | A1* | 2/2012 | Westrup | A45C 3/02<br>206/320 |

* cited by examiner

GOLF ACCESSORY HOLDER

CROSS REFERENCE TO RELATED APPLICATION

This application claims the benefit of U.S. Provisional Application No. 62/925,999 filed on Oct. 25, 2019. The above identified patent application is herein incorporated by reference in its entirety.

BACKGROUND OF THE INVENTION

The present invention relates to accessory holders. The present invention specifically relates to a device for holding golf accessories, wherein the device secures to a support such as a belt, golf bag, waist band, piece of clothing or other article that is carried while golfing.

There are various accessories avid golfers need, to play a proper round of golf. These accessories range from ball markers and golf tees to divot repair tools. When golfing, divots are created in the turf caused by golf balls striking the ground as they land. These divots must be repaired or further damage to the turf will occur. There are many types of golf tools for repairing divots. These repair tools are small items, oftentimes easily held in one's palm. However, golfers tend to lose or misplace these divot repair tools as they are typically tossed in a golf bag or hand carried and left in places last used. Similarly, various other golfing accessories are small and oftentimes misplaced.

Some devices exist that can hold a divot repair tool. However, these devices are composed of a flimsy, non-rigid material that forms a pocket having an opening along an upper end of the pocket. The top opening provides restricted access while a user has to reach his or her hand within the pocket to remove the repair tool. Further, the cloth-like material allows the repair tool to become snagged on the holder, which makes it difficult for the user to easily access the repair tool. Additionally, these holders secure to a shoe of the user, rendering it more difficult of a person with less flexibility and older age must bend over to access.

Some existing devices have holders for golf tees. However, these devices fail to include a golf tee receiver having an opening between an upper and lower end to provide flexibility to receive golf tees of varying girth or snap in from a side of the golf tee receiver. Therefore, there exists a need for an accessory holding device that conveniently secures to a belt, golf bag, waist band, piece of clothing or other article that is carried when golfing and allows a user to easily remove the accessories unincumbered by the holder.

In light of the devices disclosed in the known art, it is submitted that the present invention substantially diverges in design elements and methods from the known art and consequently it is clear that there is a need in the art for an improvement for a golf accessory holder. In this regard the instant invention substantially fulfills these needs.

SUMMARY OF THE INVENTION

In view of the foregoing disadvantages inherent in the known types of golf accessory holders now present in the known art, the present invention provides a new golf accessory holder wherein the same can be utilized for securing golf accessories to a user or a golf bag, such that the golf accessories are easily accessed at all times when golfing.

It is an objective of the present invention to provide a golf accessory holder comprising a housing having a front side and a rear side, wherein the front side comprises a base and a sidewall extending from the base toward an open face defining a compartment configured to receive a ball divot repair tool. The sidewall forms a perimeter of the housing, wherein the open face extends the perimeter. The divot repair tool is inserted into the compartment through the open face. A fastener extends from the rear side of the housing to secure the golf accessory holder to a support.

It is another objective of the present invention to provide a golf accessory holder to provide a fastening mechanism to secure the divot repair tool to the housing. In some embodiments, a lip protrudes from the sidewall and extends over the open face to prevent the divot repair tool from falling out of the housing. In some embodiments, a divot repair tool fastener is disposed on a surface of the front side configured to magnetically secure the ball divot repair tool to the housing.

It is yet another objective of the present invention to provide a golf accessory holder wherein the housing is a rigid structure. In some embodiments, the housing is monolithic.

It is yet another objective of the present invention to provide a golf accessory holder further comprising a pair of golf tee receivers disposed on opposing lateral, exterior sides of the sidewall of the housing.

It is yet another objective of the present invention to provide a golf accessory holder wherein some embodiments, the golf accessory holder includes the divot repair tool. The divot repair tool having configured to removably receive a ball marker, wherein the ball marker is interchangeable with other ball markers in order to allow for a variety of colors or embodiments to be displayed on the divot repair tool. In this way, the user can mix and match accessories for different color schemes or advertising purposes.

It is yet another objective of the present invention to provide a golf accessory holder comprising specific receivers and cavities for a divot repair tool, golf tees, and a ball marker. In this way, these small golfing accessories can be safely and portably stored to avoid losing the tools and allow for hands-free transportation.

It is therefore an object of the present invention to provide a new and improved golf accessory holder that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for conveniently securing golf accessories to a belt, golf bag, waist band, piece of clothing or other article that is carried while golfing. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment. Additionally, "device," "accessory holder," and "holder" may be used interchangeably, and each refer to the present invention.

Figure 1:
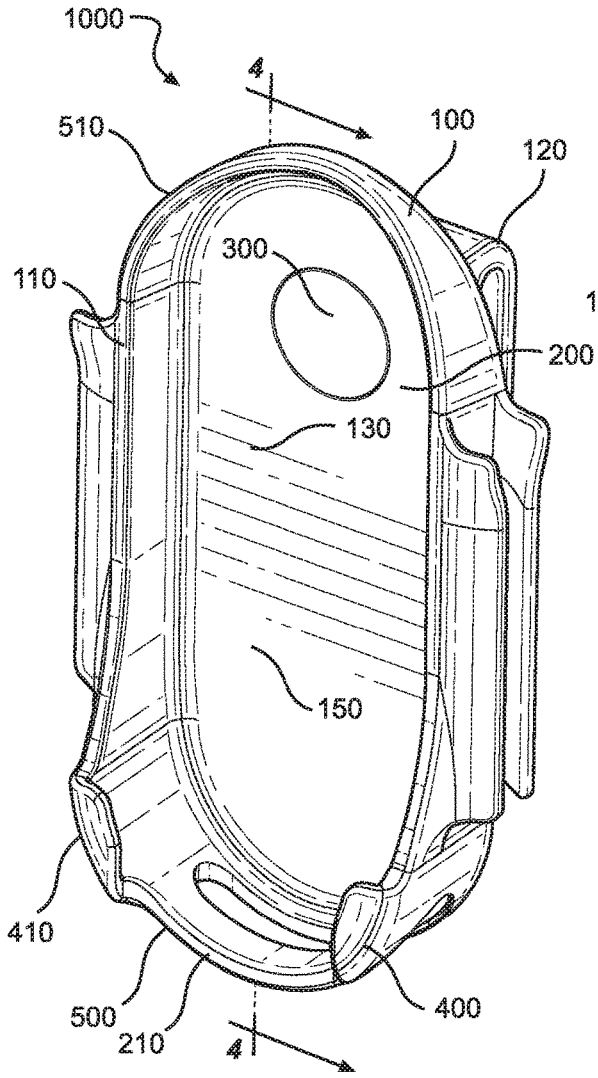
FIG. 1 shows a front perspective view of an embodiment of the golf accessory holder.
Figure 2:
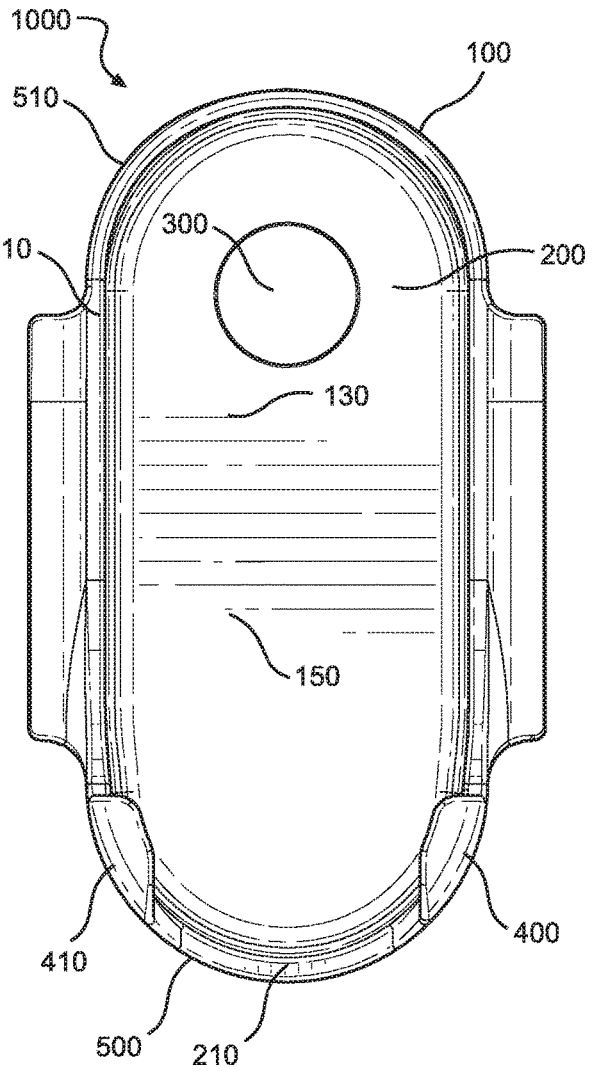
FIG. 2 shows a front view of an embodiment of the golf accessory holder.

Referring now to FIGS. 1 and 2, there is shown a front perspective view and a front view of an embodiment of the golf accessory holder. The golf accessory holder 1000 comprises a housing 100 having a front side 110 and a rear side 120, wherein the front side 110 is configured to receive a divot repair tool and the rear side 120 is configured to secure to a support intended to be worn or carried by a user, such as a belt, golf bag, waist band, article of clothing and the like. The front side 110 comprises a base 130 and a sidewall 140, wherein the sidewall 140 extends from the base 130 toward an open face 150. The base 130 and sidewall 140 define a compartment 200 configured to receive the divot repair tool.

In the illustrated embodiment, the sidewall 140 forms an exterior perimeter 210 of the housing 100. The sidewall 140 extends entirely around the base 130, such that when the divot repair tool is disposed within the compartment 200 the sidewall extends entirely therearound. In other embodiments, the sidewall does not extend entirely around the base. In the illustrated embodiment, the sidewall 140 is rounded and is coextensive with the perimeter of the base 130. The base 130 and the sidewall 140 form a substantially oval cross-sectional shape along a vertical plane. In alternate embodiments, the sidewall and base form any suitable cross-sectional shape, such as a rectangle.

Figure 9:
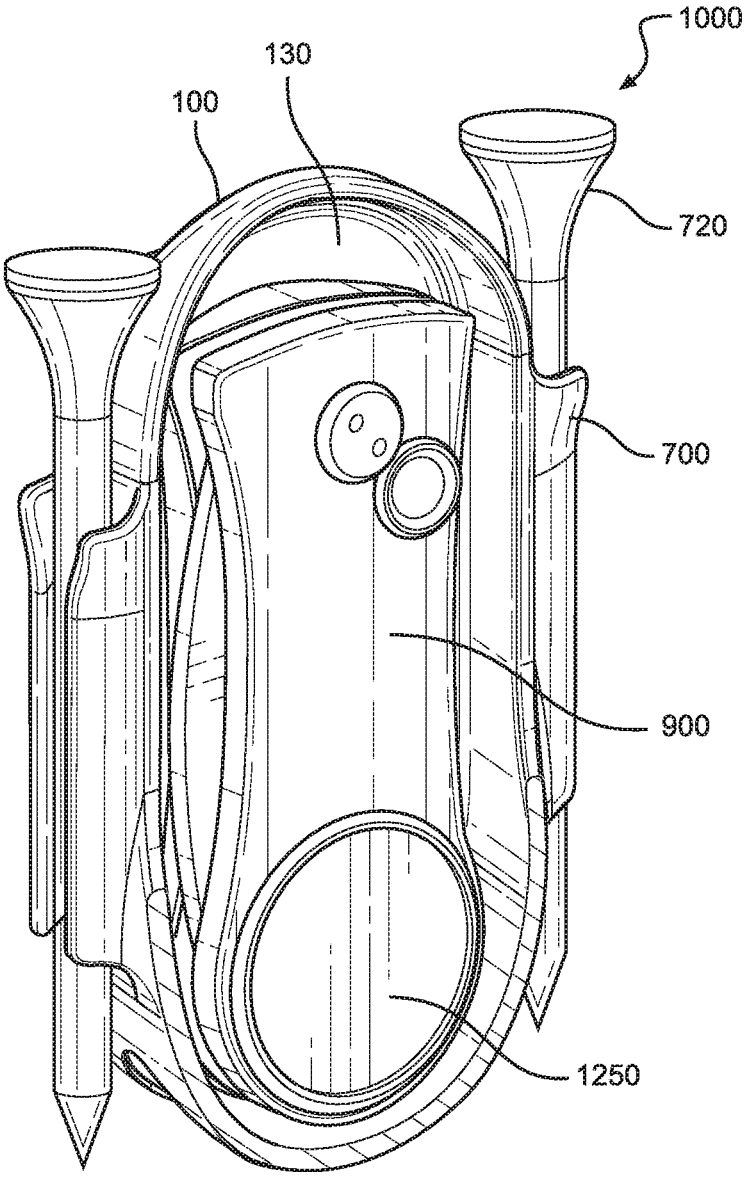
FIG. 9 shows a perspective view of an embodiment of the golf accessory holder in use.

In some embodiments, the open face 150 extends the perimeter 210 of the sidewall 140 such that the divot repair tool can be positioned directly into the compartment 200 while both the compartment 200 and divot repair tool are vertically oriented (as shown in FIG. 9). The orientation of the compartment 200 and the open face 150 allows the divot repair tool to be easily and conveniently inserted and removed from the holder 1000 without requiring a compartment 200 in the form of a pocket. The open face 150 provides ample room for the divot repair tool to received and removed from the compartment 200.

In some embodiments, the golf accessory holder 1000 comprises a divot repair tool fastener 300 to secure the divot repair tool to the housing 100. In the illustrated embodiment, the divot repair tool fastener 300 is a circular shaped magnet disposed on an upper end of the base 130 of the housing 100. In some embodiments, the magnet is embedded within a recess in the base 130. The magnet is configured to secure to a divot repair tool composed of a ferromagnetic material. In this way, when the divot repair tool is disposed within the compartment 200 it will retain an upright position via the magnetic fastener. In some embodiments, the magnet is removable from the base 130 and can be replaced with an alternate magnet or other divot repair tool fastener 300, such as an adhesive. In other embodiments, the divot repair tool fastener 300 is any suitable fastener, such as an adhesive, clip, hook and loop material, and the like. In other embodiments, the base 130 is composed of a magnetic material such that the entire base 130 is configured to secure the divot repair tool thereto. The magnet can be any suitable shape configured to secure the divot repair tool to the housing 100.

In the illustrated embodiment, the golf accessory holder 1000 comprises a lip or flange extending from the edge of sidewall 140 to prevent the divot repair tool from falling out of the housing 100. In the illustrated embodiment, a first lip 400 extends from a lower first corner of the sidewall 140 and a second lip 410 extends from an adjacent lower second corner of the sidewall 140. The lips 400, 410 slightly extend over the open face 150 such that the lips are parallel to the base 130. In this way, the lower portion of the divot repair tool is prevented from sliding out of the compartment 200. Further, in the illustrated embodiment, the height of the sidewall 140 tapers from a lower end 500 of the housing 100 to the upper end 510, wherein the height is measured between the base 130 and the open face 150. In this way, the lower end of the housing 100 provides additional stability and security when the divot repair tool is disposed therein. Some embodiments do not include the lips extending from the sidewall and other embodiments comprise a non-tapered sidewall that does not vary in height.

Figure 3:
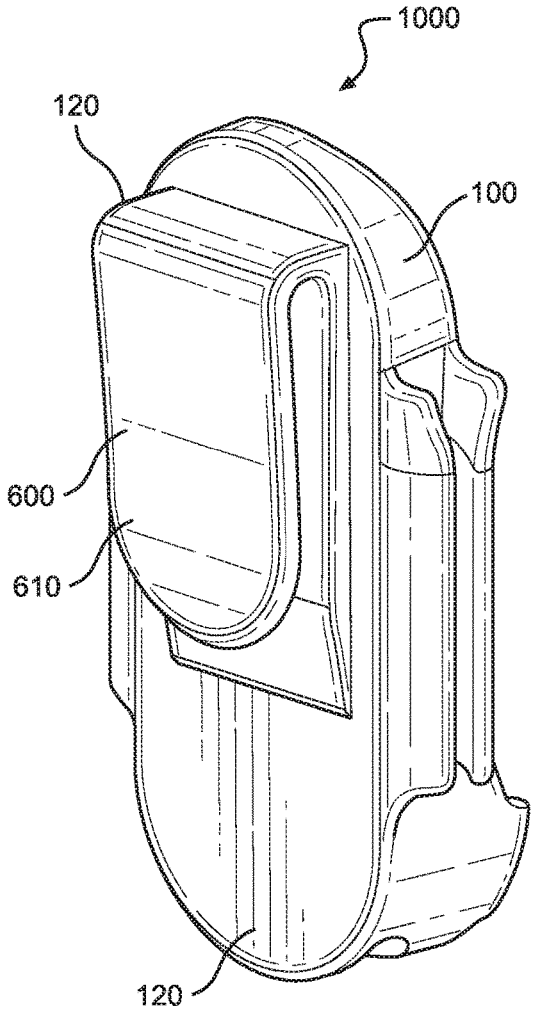
FIG. 3 shows a rear perspective view of an embodiment of the golf accessory holder.
Figure 4:
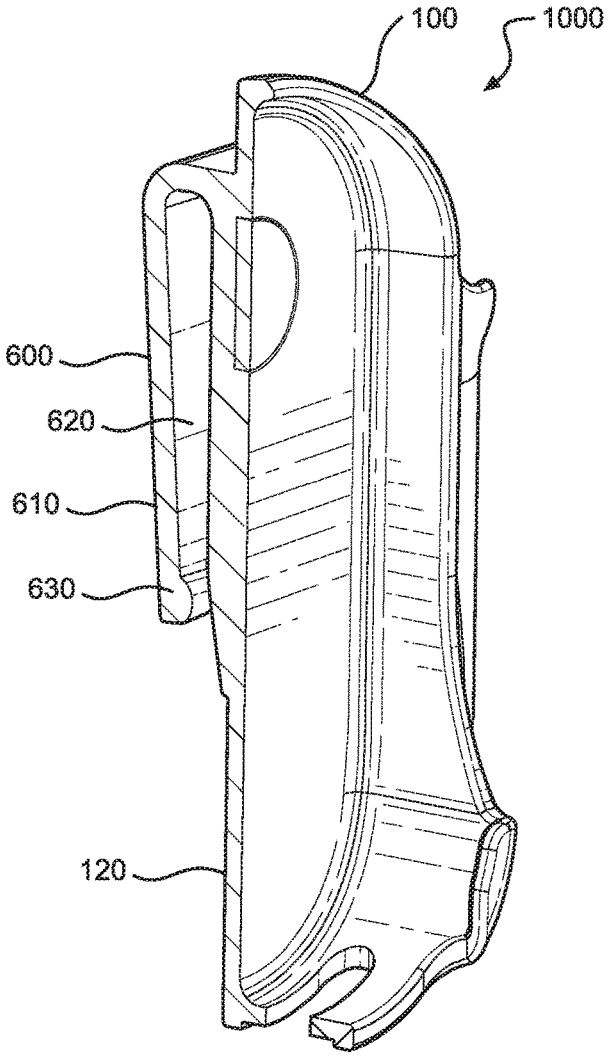
FIG. 4 shows a cross-sectional view of an embodiment of the golf accessory holder taken along line 4-4 of FIG. 1.

Referring now to FIGS. 3 and 4, there is shown a rear perspective view of an embodiment of the golf accessory holder and a cross-sectional view of an embodiment of the golf accessory holder taken along line 4-4 of FIG. 1, respectively. In the illustrated embodiment, a fastener 600 extends from the housing 100 and is configured to secure the golf accessory holder 1000 to the support. In some embodiments, the fastener 600 is a clip 610 extending from the rear side 120 of the housing 100. The clip 610 comprises a U-shape and together with the housing 100 define a gap 620 configured to receive an object in which to be secured thereto. In the illustrated embodiment, the free end of the clip 610 comprises a protrusion 630 configured to prevent the object or support from being removed from the gap 620 unless force is used for removal. The protrusion 630 serves to narrow the gap 620, pinching the support between the rear side 120 the housing 100 and the protrusion 630. In alternate embodiments, the holder 1000 comprises any suitable fastener 600 configured to secure the housing 100 to the support, such as a clamp, a hook, a clasp, a strap, a magnetic fastener, and the like.

In the illustrated embodiment, the housing 100 is rigid to protect the accessories secured thereto. The rigidity of the housing 100 further provides structural support to the divot repair tool when disposed therein. In some embodiments, the housing 100 is a monolithic structure. In other embodiments, the housing 100 and clip 610 form a monolithic structure.

Figure 5:
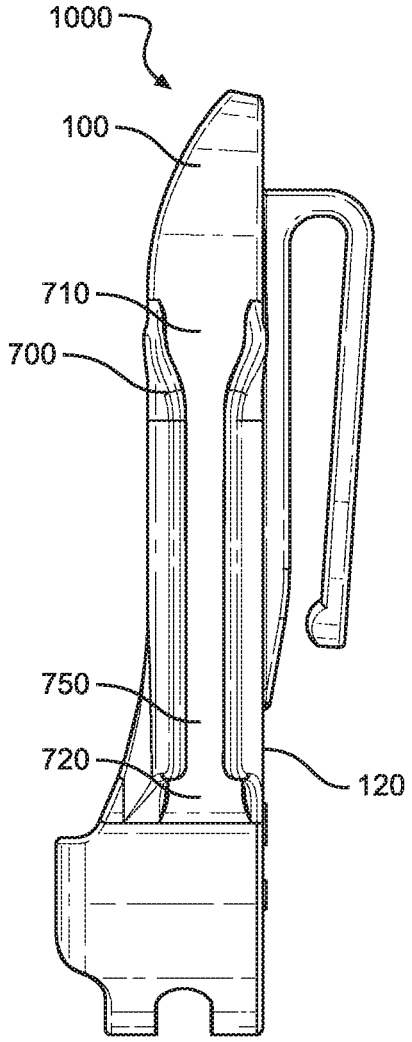
FIG. 5 shows a side view of an embodiment of the golf accessory holder.
Figure 6:
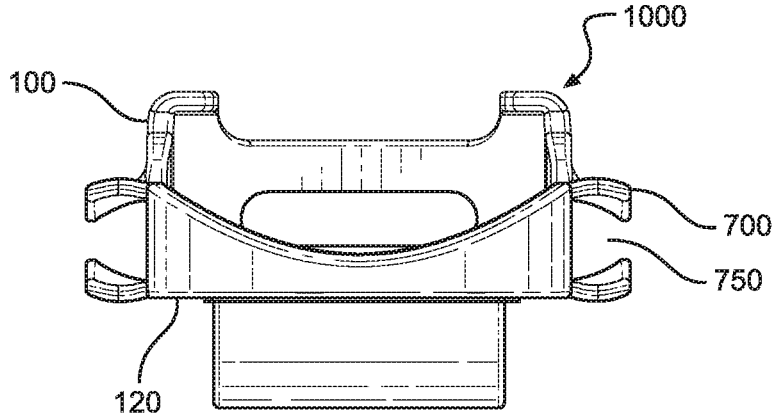
FIG. 6 shows a top view of an embodiment of the golf accessory holder.

Referring now to FIGS. 5 and 6, there is shown a side view and a top view of an embodiment of the golf accessory holder, respectively. In the illustrated embodiments, the golf accessory holder 1000 comprises a slot 700 extending from the housing 100 and configured to receive a golf tee therein. In the illustrated embodiment, a pair of slots 700 are disposed on opposing lateral sides of the housing 100, extending from an exterior of the sidewall 140. In alternate embodiments, the slot 700 can be disposed anywhere on the housing 100, such as the rear side 120. In the illustrated embodiment, each slot comprises an open side 750 extending between an open upper end 710 to an open lower end 720. The open side allows the sides of the slot to flex thereby allowing the circumference of the slot to be nominally increased to more easily permit the golf tee to be removed as well as receive golf tees of varying sizes. In some embodiments, the upper and lower ends 710, 720 of the slot 700 tapers toward a center thereof to allow for larger open ends for removing and receiving the golf tees.

Figure 7:
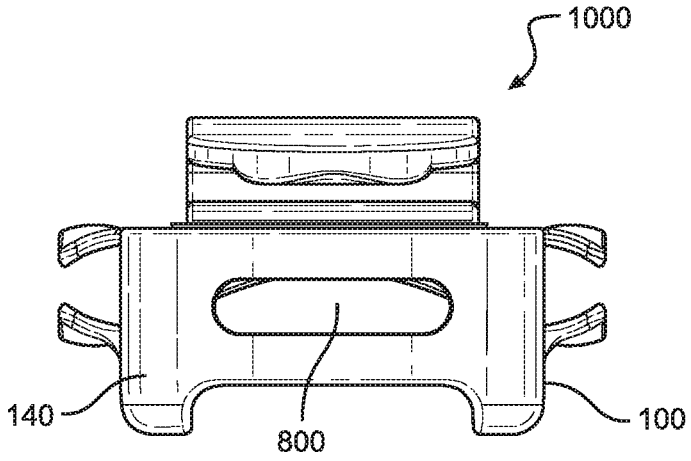
FIG. 7 shows a bottom view of an embodiment of the golf accessory holder.

Referring now to FIG. 7, there is shown a bottom view of an embodiment of the golf accessory holder. In the illustrated embodiment, the housing 100 comprises a port 800 on the lower end of the sidewall 140. The port 800 is configured to receive a prong of a divot repair tool therethrough. The port 800 allows for certain variations of the divot repair tool to extend outside of the perimeter of the housing 100. In some embodiments, the port 800 is elongated and comprises a rectangular or oval shaped opening configured to receive one or more prongs of a divot repair tool. In other embodiments, the port comprises a circular shape and designed to receive a single or dual prong of a divot repair tool. The port 800 is centrally positioned along the lowermost side of the sidewall so as to align with the divot repair tool positioned within the compartment 200.

Figure 8:
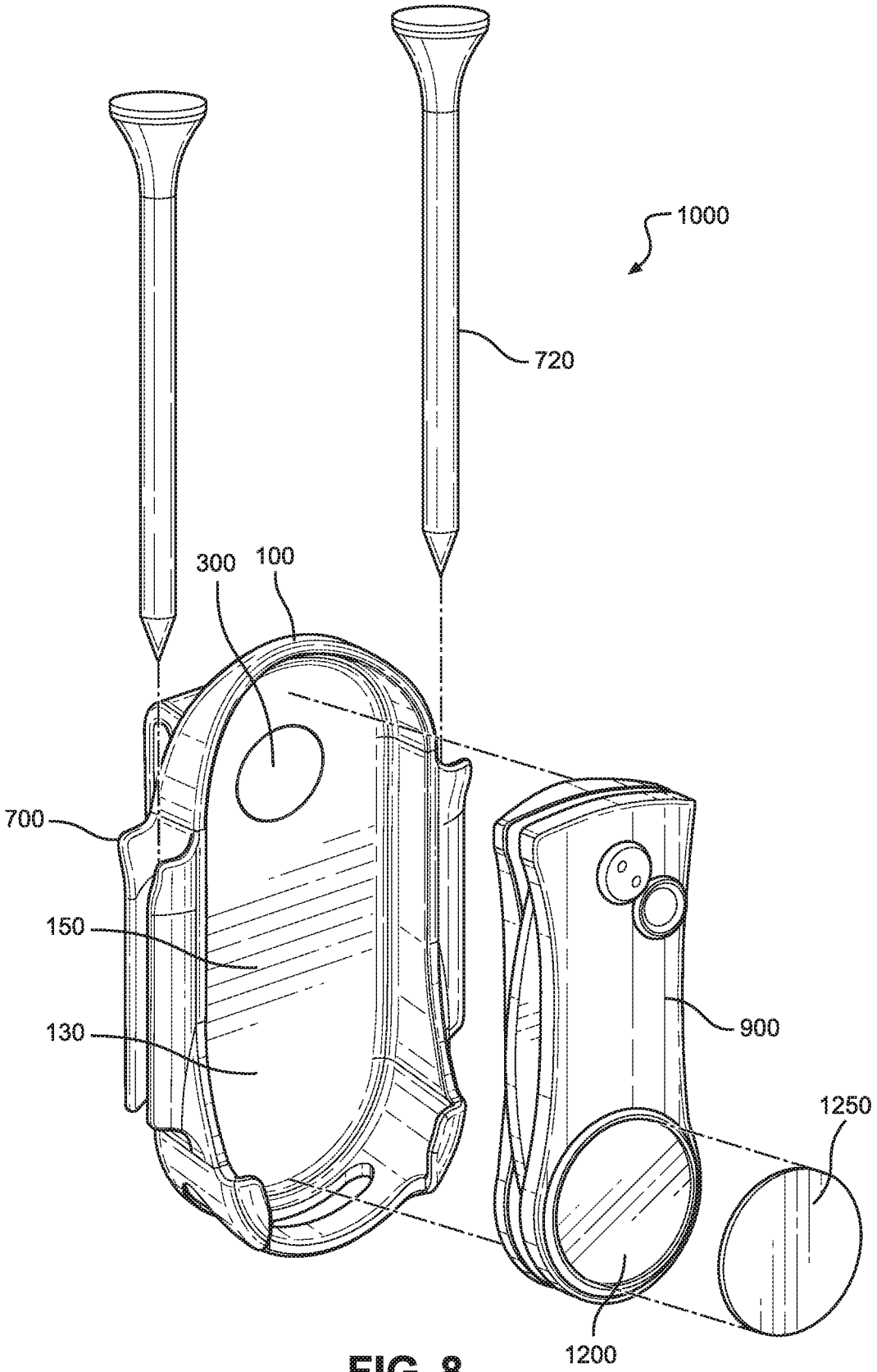
FIG. 8 shows an exploded view of an embodiment of the golf accessory holder.

Referring now to FIGS. 8 and 9, there is shown an exploded view of an embodiment of the golf accessory holder and a perspective view of an embodiment of the golf accessory holder in use, respectively. In some embodiments, the golf accessory holder 1000 includes the divot repair tool 900, wherein the divot repair tool 900 comprises either a singular or two-pronged type. In other embodiments, the divot repair tool comprises a three or more-pronged type. In other embodiments, the golf accessory holder 1000 comprises one or more golf tees 720 removably disposed within the golf tee slots 700.

In the illustrated embodiment, the compartment 200 is sized to receive the divot repair tool 900 such that the edges of the tool 900 are in close tolerance with the sidewall 140. Further, the divot repair tool fastener 300 is centrally disposed on the base to secure to the upper end of the tool 900 such that the divot repair tool is centrally positioned within the housing 100.

In some embodiments, the divot repair tool comprises a circular ball marker cavity 1200 and circular ball marker 1250 disposed on a front side 910 thereof, wherein the ball marker 1250 is magnetically securable to the ball marker cavity 1200. In alternate embodiments, the ball marker cavity 1200 is any suitable shape configured to magnetically receive the ball marker 1250. In other embodiments, the ball marker is secured to the ball marker cavity in any suitable manner, such as a friction fit. The ball marker 1250 is configured to be interchangeable with other ball markers. In this way, the ball marker 1250 can be replaced and exchanged for ball markers unique or personalized to the user. Personalized ball markers allow for easier identification of the location of a user's golf ball during play.

In some embodiments, the housing 100 includes an accessory fastener configured to removably receive a golf glove. In some embodiments, the accessory fastener is a circular hook-and-loop member positioned on the exterior of the housing 100 and to configured to receive a hook-and-loop component of the golf glove to keep the glove attached thereto. In other embodiments, the accessory fastener is magnetic and configured to secure to a golf accessory having ferromagnetic properties.

In operation, a user secures the housing 100 to a support, such as a belt, golf bag, waist band, piece of clothing or other article that is carried when golfing, via the fastener disposed on the rear side thereof. The divot repair tool 900 is placed or slid into the compartment 200 of the housing 100, wherein the divot repair tool fastener 300 magnetically secures the divot repair tool 900 to the housing 100. The magnetic fastener 300 and wide open face 150 allow the user to quickly and easily position with divot repair tool within the housing with only one hand and without the need to manipulate or open the compartment (such as with a flexible/fabric holder) to replace the divot repair tool therein. The user can grasp the divot repair tool at any area thereof while it is in the compartment 200 because the open face 150 of the housing 100 provides ample room for the user to easily grasp and remove the tool therefrom. In the illustrated embodiment, when the divot repair tool 900 is positioned within the compartment, there is an open space within the compartment between the top of the divot repair tool 900 and the top edge of the sidewall of the housing 100 that assists with the removal of the divot repair tool 900. The open area is configured to receive one or more fingers of the user to grasp the divot repair tool 900 and unfasten the divot repair tool from the divot repair tool fastener.

In the illustrated embodiment, the golf tee slots 700 can each receive a golf tee. Additionally, the compartment, the ball marker cavity, and the golf tee slots allow for placement of different colored and/or styles of accessories such as golf tees, divot repair tools, and ball markers for enhanced display or coordination of color schemes between the various accessories.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf accessory holder, comprising:

a housing having a front side and a rear side, wherein the front side comprises a base and a sidewall having a depth and extending from the base defining a compartment having an open face configured to receive a divot repair tool;

wherein the sidewall forms an exterior perimeter of the housing, wherein the sidewall defines an outer edge of the open face and the open face is coextensive with the compartment;

a fastener extending from the housing to secure the golf accessory holder to a support;

wherein the sidewall depth tapers from a lower end of the housing to an upper end of the housing, wherein the sidewall depth is measured between the base and the open face;

a first lip extends from a first corner of the sidewall and a second lip extends from an adjacent second corner of the sidewall, the first and second lip each adapted to retain the divot repair tool within the compartment;

wherein the lower end of the sidewall extends between the first lip and the second lip, the lower end comprises a rounded and closed exterior perimeter such the golf accessory is enclosed by the sidewall when seated within the housing.

2. The golf accessory holder of claim 1, wherein the first lip and the second lip are parallel to the base.

3. The golf accessory holder of claim 1, wherein the fastener is a clip extending from the rear side of the housing and together with the housing define a gap configured to receive an object in which to be secured thereto.

4. The golf accessory holder of claim 3, wherein the clip and housing are monolithic.

5. The golf accessory holder of claim 1, wherein the housing defines a slot disposed on a first lateral sidewall and configured to receive a golf tee, wherein an upper end and a lower end of the slot each taper and toward a center thereof.

6. The golf accessory holder of claim 5, wherein the slot comprises an open side extending between an open upper end to an open lower end.

7. The golf accessory holder of claim 1, wherein the housing defines a pair of angularly disposed slots, wherein each slot is positioned on an opposing lateral side of the sidewall and configured to receive a golf tee.

8. The golf accessory holder of claim 1, wherein the housing is rigid.

9. The golf accessory holder of claim 8, wherein the housing is monolithic.

10. The golf accessory holder of claim 9, wherein the divot repair tool fastener is a magnet disposed within a recess of the housing.

11. The golf accessory holder of claim 1, further comprising a divot repair tool fastener disposed on the base on the front side configured to secure the divot repair tool to the housing.

12. The golf accessory holder of claim 1, wherein a lower end of the sidewall comprises an opening.

13. The golf accessory holder of claim 1, further comprising an accessory fastener positioned on the exterior of the housing configured to receive a golf glove.

14. The golf accessory holder of claim 13, wherein the accessory fastener is a hook and loop material configured to receive a hook-and-loop component of the golf glove.

15. A golf accessory holder, comprising:

a housing having a front side and a rear side, wherein the front side comprises a base and a sidewall having a depth and extending from the base toward an open face defining a compartment configured to receive a divot repair tool;

a divot repair tool fastener disposed of the front side configured to secure the divot repair tool to the housing;

a fastener extending from the housing to secure the golf accessory holder to a support;

wherein the sidewall depth tapers from a lower end of the housing to an upper end of the housing, wherein the sidewall depth is measured between the base and the open face;

a first lip extends from a first corner of the sidewall and a second lip extends from an adjacent second corner of the sidewall, the first and second lip each adapted to retain the divot repair tool within the compartment;

wherein the lower end of the sidewall extends between the first lip and the second lip, the lower end comprises a rounded and closed exterior perimeter such the golf accessory is enclosed by the sidewall when seated within the housing.

16. The golf accessory holder of claim 15, wherein the sidewall forms an exterior perimeter of the housing, wherein the sidewall defines an outer edge of the open face and the open face is coextensive with the compartment.

17. A golf accessory holder, comprising:

a housing having a front side and a rear side, wherein the front side comprises a base and a sidewall having a depth and extending from the base toward an open face defining a compartment configured to receive a divot repair tool;

wherein the sidewall forms an exterior perimeter of the housing, wherein the sidewall defines an outer edge of the open face and the open face is coextensive with the compartment;

the divot repair tool;

a divot repair tool fastener disposed on a surface of the front side configured to magnetically secure the divot repair tool to the housing;

a fastener extending from the housing to secure the golf accessory holder to a support;

wherein the sidewall depth tapers from a lower end of the housing to an upper end of the housing, wherein the sidewall depth is measured between the base and the open face;

a first lip extends from a first corner of the sidewall and a second lip extends from an adjacent second corner of the sidewall, the first and second lip each adapted to retain the divot repair tool within the compartment;

wherein the lower end of the sidewall extends between the first lip and the second lip, the lower end comprises a rounded and closed exterior perimeter such the divot repair tool is enclosed by the sidewall when seated within the housing.

18. The golf accessory holder of claim 1, wherein the sidewall comprises a first lateral sidewall and a second lateral sidewall each extending between the upper and lower end of the housing, wherein the first and second lateral sidewalls are substantially linear and parallel to one another.

* * * * *